US007735180B2

(12) United States Patent
Tanaka

(10) Patent No.: US 7,735,180 B2
(45) Date of Patent: Jun. 15, 2010

(54) CLEANING SHEET

(75) Inventor: Yoshinori Tanaka, Kagawa (JP)

(73) Assignee: Uni-Charm Corporation, Shikokuchuo-shi (JP)

( * ) Notice: Subject to any disclaimer, the term of this patent is extended or adjusted under 35 U.S.C. 154(b) by 882 days.

(21) Appl. No.: 11/133,362

(22) Filed: May 20, 2005

(65) Prior Publication Data

US 2005/0268419 A1 Dec. 8, 2005

(30) Foreign Application Priority Data

Jun. 3, 2004 (JP) ..... 2004-166288

(51) Int. Cl.
*A47L 13/10* (2006.01)

(52) U.S. Cl. ..... 15/209.1; 15/208; 15/228

(58) Field of Classification Search ..... 15/208, 15/209.1, 228, 223; 428/77, 192; 442/381, 442/389, 394, 400, 414, 149
See application file for complete search history.

(56) References Cited

U.S. PATENT DOCUMENTS

| | | | | |
|---|---|---|---|---|
| 6,119,298 | A * | 9/2000 | Kenmochi | 15/231 |
| 6,245,413 | B1 * | 6/2001 | Kenmochi et al. | 428/157 |
| 6,766,552 | B1 * | 7/2004 | Policicchio et al. | 15/228 |
| 2003/0110584 | A1 * | 6/2003 | Clare et al. | 15/104.94 |
| 2006/0137119 | A1 * | 6/2006 | Otsuka et al. | 15/104.002 |
| 2006/0137123 | A1 * | 6/2006 | Sampaio | 15/209.1 |

FOREIGN PATENT DOCUMENTS

| | | |
|---|---|---|
| DE | 101 26 358 | 7/2002 |
| DE | 103 10 320 | 3/2004 |
| EP | 0702926 | 3/1996 |
| JP | 62-13008 | 3/1987 |
| JP | 2507300 | 5/1996 |
| JP | 2516320 | 8/1996 |
| JP | 09-075284 | 3/1997 |
| JP | 09-187411 | 7/1997 |
| JP | 10-286206 | 10/1998 |
| JP | 11-206661 | 8/1999 |
| JP | 2000-507480 | 6/2000 |
| JP | 3042737 | 10/2000 |
| JP | 2001-506519 | 5/2001 |
| JP | 2003-024254 | 1/2003 |
| JP | 2004-033237 | 2/2004 |
| WO | WO-00/53411 | 9/2000 |
| WO | WO-01/62132 | 8/2001 |

OTHER PUBLICATIONS

Pending related U.S. Appl. No. 10/995,941.
European Search Report mailed Mar. 31, 2008, directed to counterpart EP application No. 05253210.8; 3 pages.

* cited by examiner

*Primary Examiner*—Dung Van Nguyen
(74) *Attorney, Agent, or Firm*—Morrison & Foerster LLP

(57) ABSTRACT

Disclosed is a cleaning sheet to be attached to a cleaning head. The cleaning sheet has an attachment surface coated with a viscoelastic polymer such as SEBS for preventing slipping of the cleaning sheet relative to the cleaning head. Over the working temperature range between −20° C. and 40° C., the viscoelastic polymer has a stable storage modulus (G') of $10^4$ to $10^6$.

16 Claims, 5 Drawing Sheets

CLEANING SHEET

BACKGROUND OF THE INVENTION

1. Field of the Invention

The present invention relates to a cleaning sheet which is intended to be used for cleaning a floor surface or the like when attached to a cleaning head of a mop-like cleaning device, and more particularly to a cleaning sheet which is resistant to slipping relative to a bottom face of the cleaning head.

2. Description of the Related Art

There have been known cleaning sheets which may be used for cleaning the house floor when attached to a cleaning head of a mop-like cleaning device. Such conventional cleaning sheets are typically constructed of a single nonwoven fabric or by layering two or more nonwoven fabrics on top of one another and used in a dry state or in a wet state with water or detergent contained in a liquid absorbent layer. Moreover, they are preferably disposable and easy to attach to and detach from the cleaning head of the cleaning device.

Japanese Examined Patent Publication No. S62-013008 discloses a loop tape of a Velcro fastener secured on either a cleaning head or a cleaning member to be attached to the cleaning head and a hook tape of the Velcro fastener secured on the other.

Japanese Utility-Model Registration No. 2507300 discloses retainers which are slashed sheets and disposed on a top face of a cleaning head. By tucking a part of a cleaning sheet into cuts of the retainers, the cleaning sheet can be retained on the cleaning head.

Japanese Unexamined Patent Publication No. H09-187411 discloses clamp members pivotally mounted on a top face of a cleaning head. By clamping a part of a cleaning sheet between the clamp members and the cleaning head, the cleaning sheet can be retained on the cleaning head.

Japanese Unexamined Patent Publication No. H09-075284 discloses a pressure-sensitive adhesive layer (or sticky layer) disposed on a bottom face or top face of a cleaning head for retaining a cleaning sheet on the bottom face.

In the invention disclosed in Patent Publication No. S62-013008, either of the loop tape and the hook tape must be provided on the cleaning sheet for enabling the use of the Velcro fastener. However, if the cleaning sheet is designed to be thrown away after use (or disposable), providing the loop/hook tape on the cleaning sheet will raise the cost.

On the other hand, the mechanisms disclosed in Utility-Model Registration No. 2507300 and Patent Publication No. H09-187411 are suitable for use with a disposable cleaning sheet. Here, the cleaning sheet is retained such that its central portion is laid on the bottom face of the cleaning head and its side portions are folded back and secured on the top face of the cleaning head. However, in the case where only the side portions of the cleaning sheet are secured on the cleaning head, the central portion of the cleaning sheet, which is laid on the bottom face of the cleaning head, tends to slip and shift by the friction between the cleaning sheet and the floor surface or the like during cleaning.

In order to prevent slipping between the cleaning head and the cleaning sheet, the bottom face of the cleaning head may be made of a material having a relatively high coefficient of friction such as urethane foam resin, but even in this case, it is still difficult to prevent slipping between the cleaning head and the cleaning sheet if the frictional resistance between the cleaning sheet and the floor surface is high.

On the other hand, the pressure-sensitive adhesive layer disclosed in Patent Publication No. H09-075284 is not practical because its adhesion decreases with the passage of time and also by dirt or dust adhering to the pressure-sensitive adhesive layer.

SUMMARY OF THE INVENTION

The present invention has been developed to solve the problems in the prior art set forth above and has an object to provide a cleaning sheet which is effective in preventing slipping relative to a bottom face of a cleaning head.

According to the invention, there is provided a cleaning sheet comprising: a main body having an attachment surface to be applied to a cleaning head of a cleaning device and a cleaning surface opposite the attachment surface; and attachment portions to be engaged to the cleaning head, wherein the attachment surface has a viscoelastic polymer for preventing slipping.

Since the viscoelasticity is effective in preventing slipping of the cleaning sheet relative to the cleaning head, the cleaning sheet can remain stationary with respect to the cleaning head even if the frictional resistance between the cleaning sheet and the floor surface or the like is high.

The viscoelastic polymer may be selected from the group consisting of rubber-based elastomers, silicone-based elastomers and urethane-based elastomers. Preferably, the viscoelastic polymer may be a synthetic rubber comprising styrene and at least one of butylene, butadiene and isoprene.

Preferably, the viscoelastic polymer is applied to the attachment surface in a hot, molten state. Alternatively, the viscoelastic polymer may be applied to the attachment surface in an emulsion, latex or solution state. The viscoelastic polymer in a hot, molten state can be applied efficiently for mass production. On the other hand, the viscoelastic polymer in an emulsion, latex or solution state can be uniformly applied to the attachment surface of the cleaning sheet in a relatively small amount.

Preferably, the viscoelastic polymer has a storage modulus of $10^4$ to $10^6$ (Pa) over a temperature range between −20° C. and 40° C. In this viscoelastic polymer, the viscoelasticity remains stable over the temperature range for practical use. Accordingly, the viscoelastic polymer is effective in preventing slipping in both hot and cold conditions.

Here, the viscoelastic polymer preferably has a peak value of loss tangent (tan δ) below −20° C. If the viscoelastic polymer has a peak value of tan δ above −20° C., it means that the glass transition temperature is above −20° C.

Preferably, the viscoelastic polymer has a loop-tack strength equal to or less than 10 ounces. If the loop-tack strength is equal to or less than 10 ounces, the attachment surface feels less tacky to the touch. More preferably, the loop-tack strength is equal to or less than 5 ounces.

The attachment surface may be intended to be applied to a bottom face of the cleaning head which is made of ethylene-vinyl acetate (EVA). Since the viscoelastic polymer is effective in preventing slipping, the cleaning head may be made of EVA, which has a lower coefficient of friction than urethane foam resin but is superior in water resistance to urethane foam resin.

The cleaning sheet may comprise a liquid absorbent sheet which enables cleaning with liquid absorbed in the cleaning sheet.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscuring of the present invention.

Figure 1:
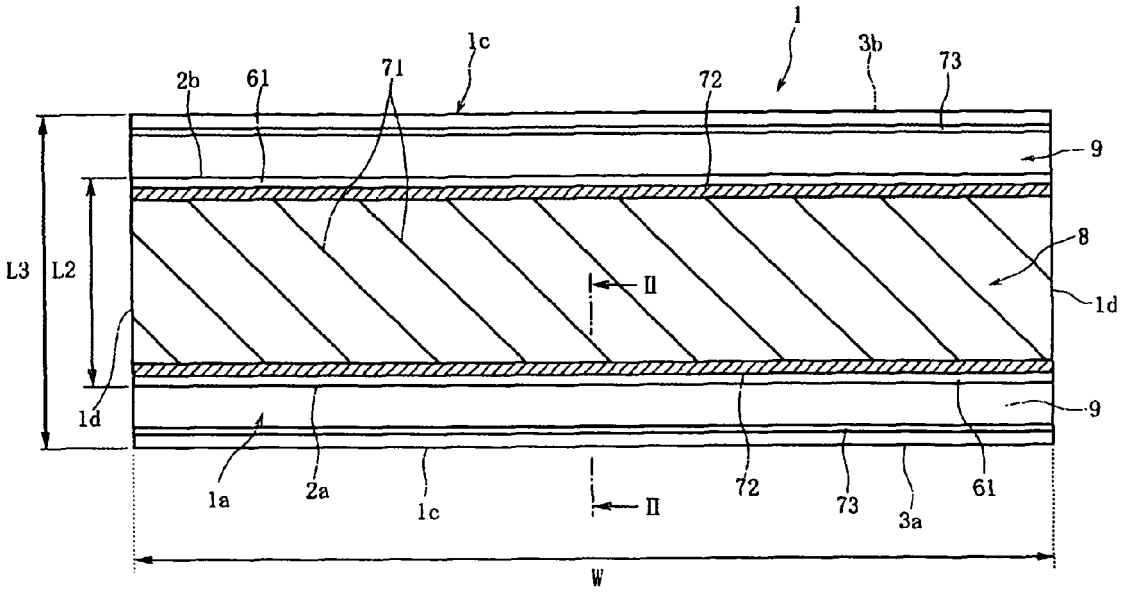
FIG. 1 is a bottom view showing a cleaning surface of a cleaning sheet according to one embodiment of the present invention.
Figure 2:
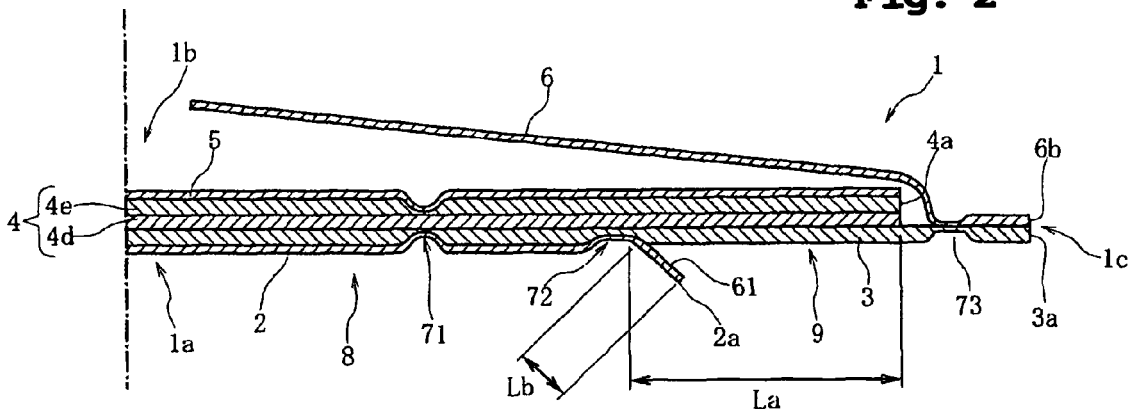
FIG. 2 is a sectional view taken along line II-II of FIG. 1.
Figure 3:
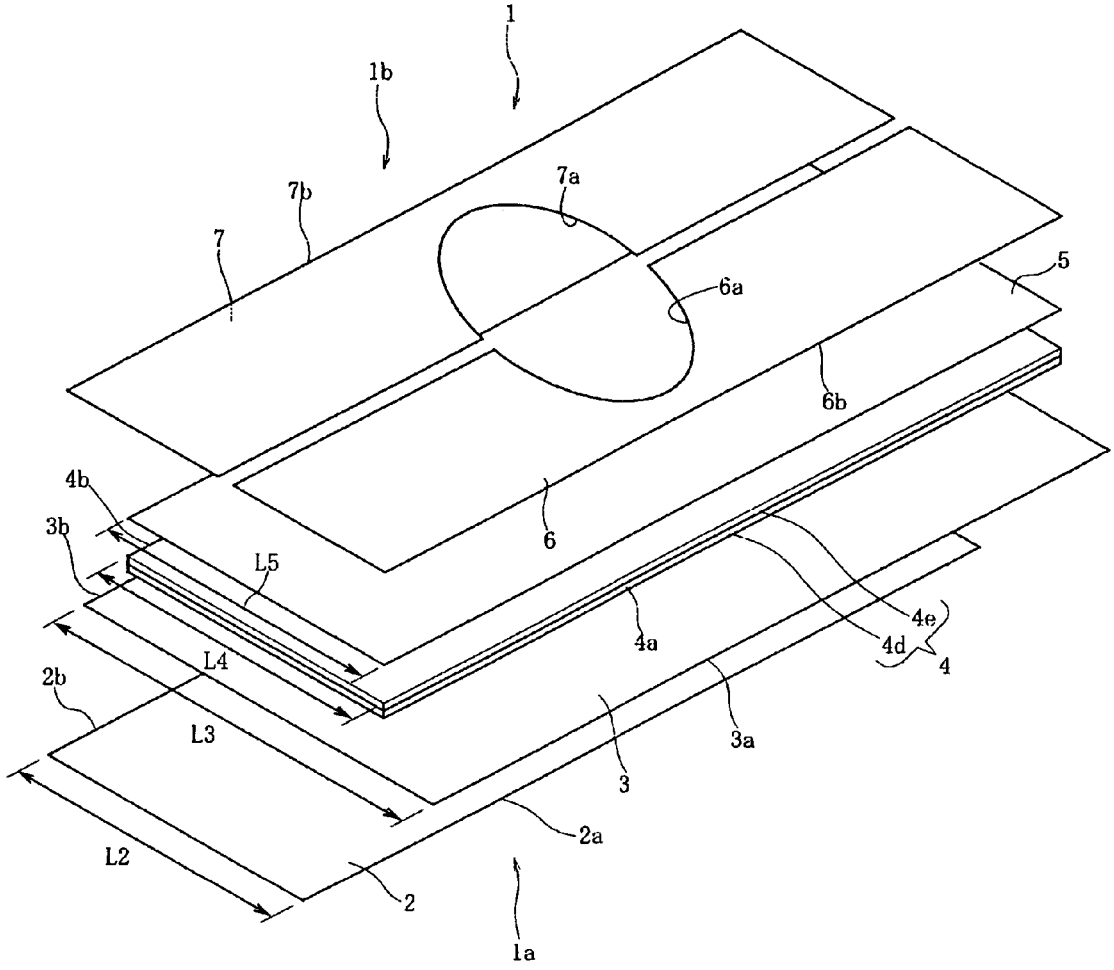
FIG. 3 is an exploded perspective view of a cleaning sheet according to an embodiment of the invention.
Figure 4:
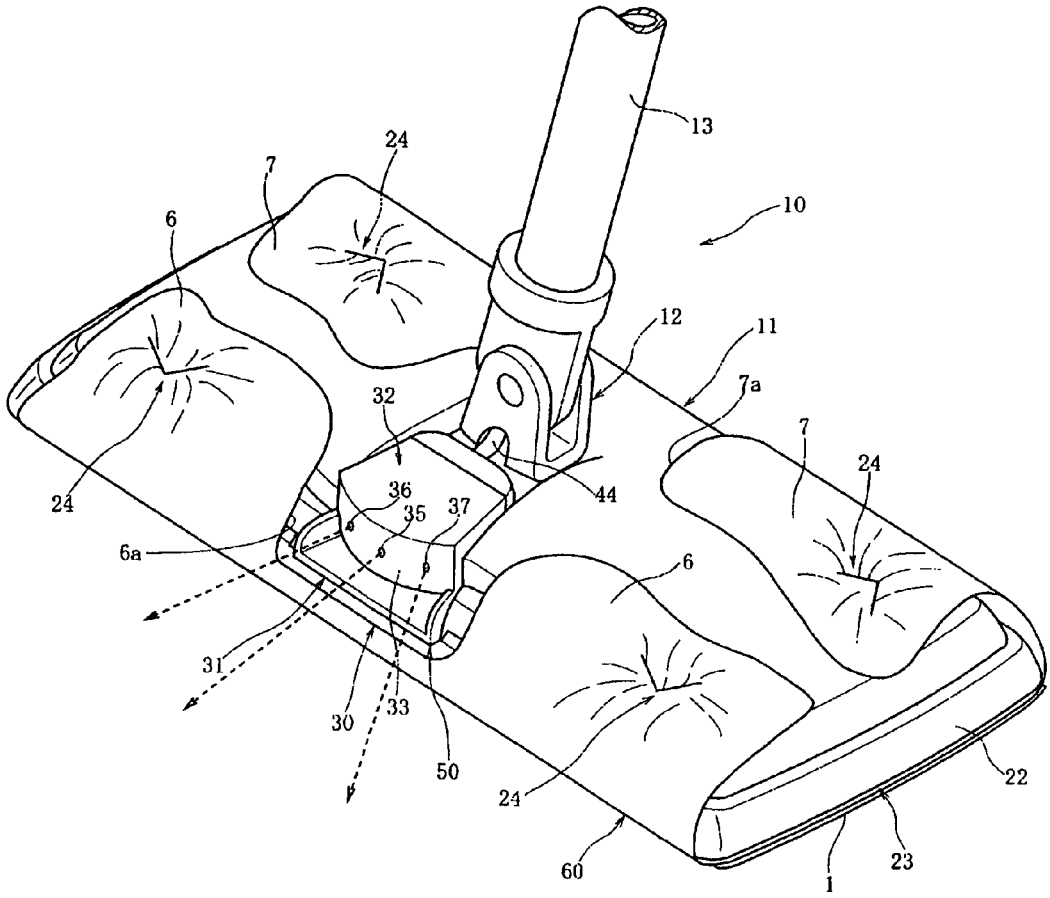
FIG. 4 is a perspective view showing a state where a cleaning sheet is attached to a cleaning head of a cleaning device according to an embodiment of the invention.
Figure 5:
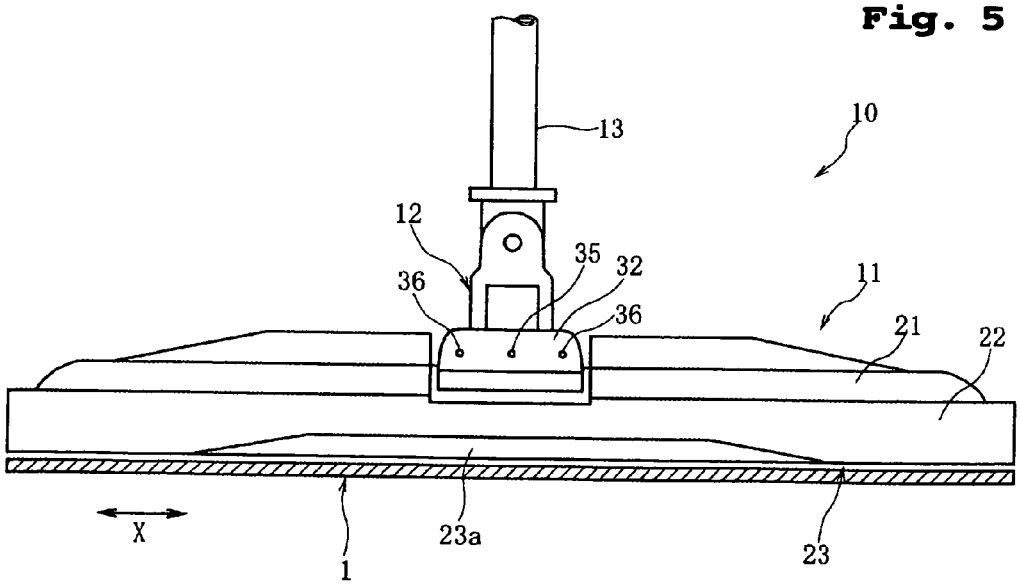
FIG. 5 is a front view of a cleaning head.
Figure 6:
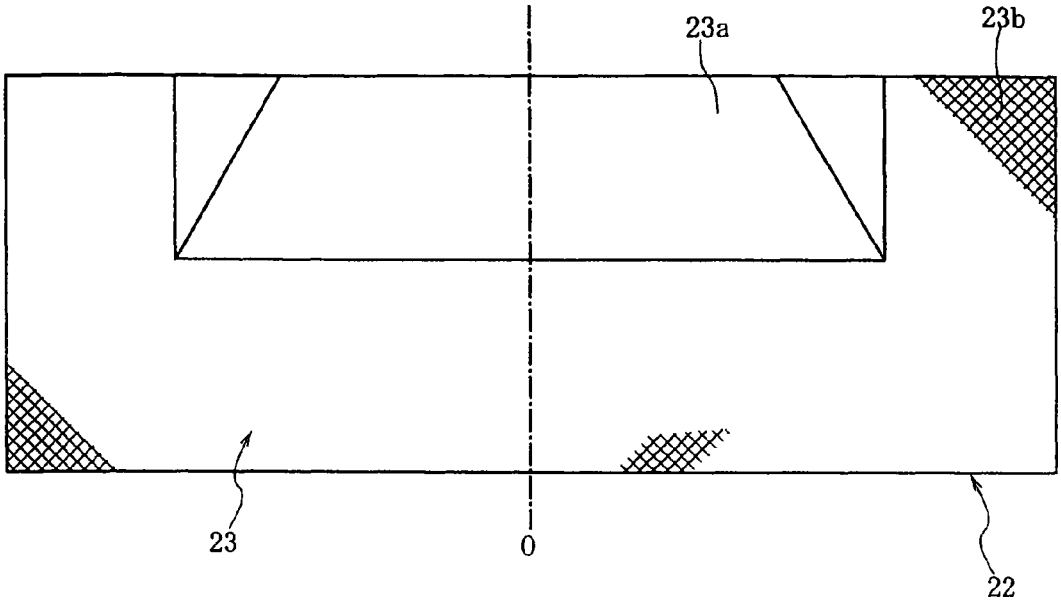
FIG. 6 is a bottom view of a cleaning head.
Figure 7:
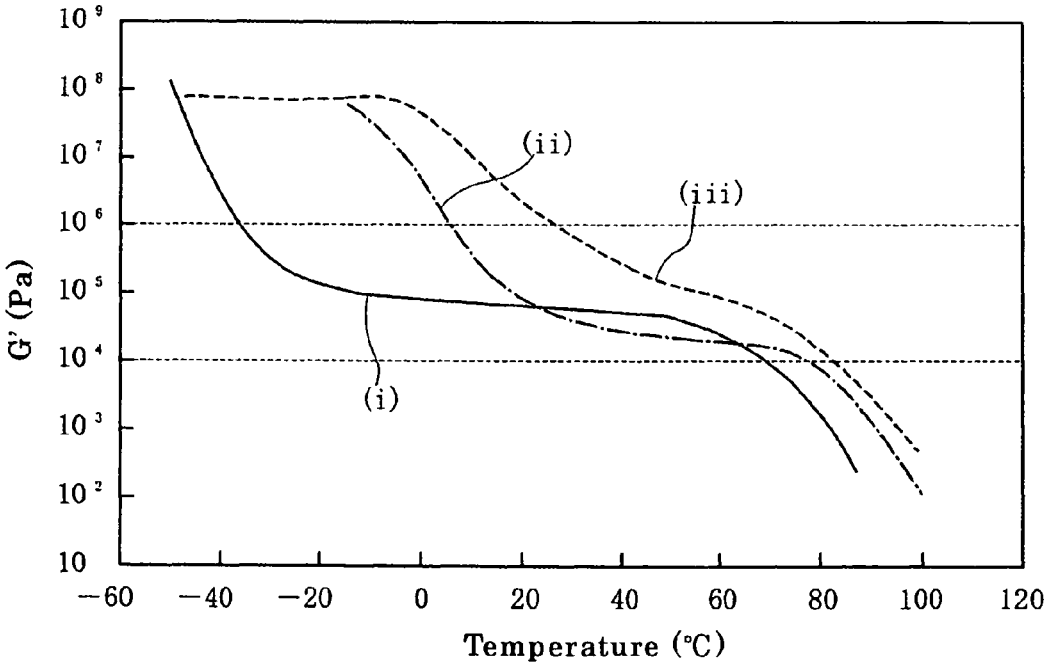
FIG. 7 is a diagram showing a temperature characteristic of storage modulus of a preferred viscoelastic polymer according to an embodiment of the invention.
Figure 8:
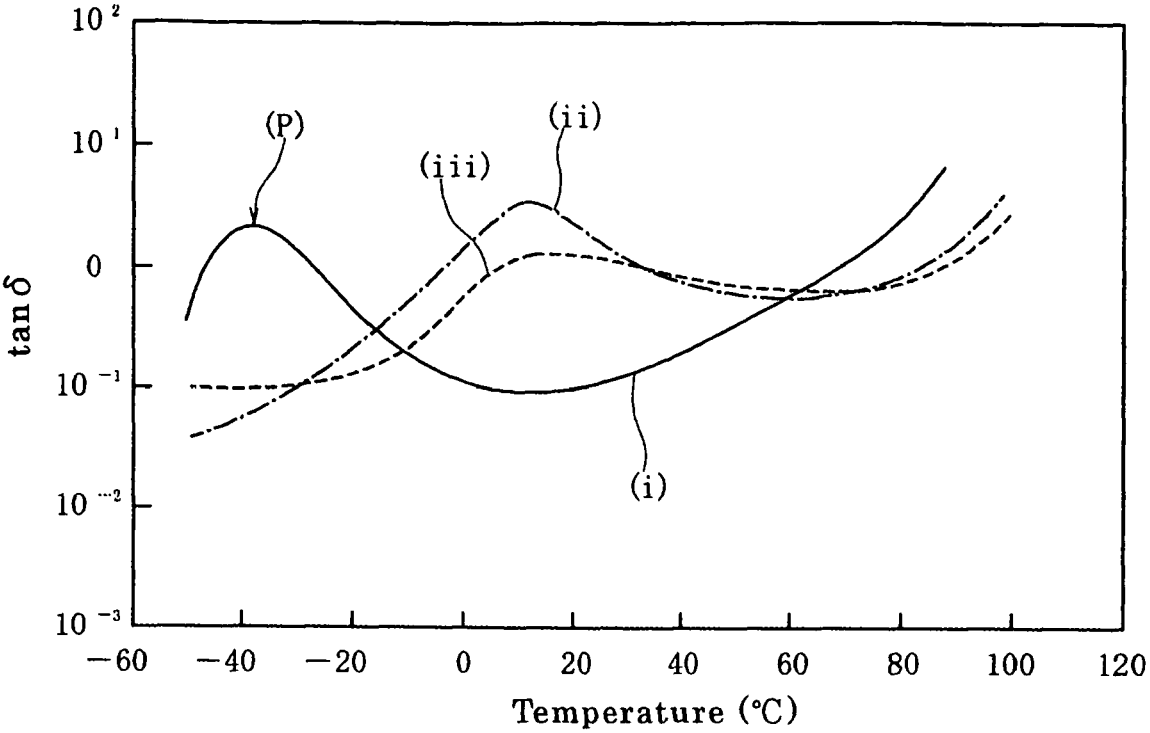
FIG. 8 is a diagram showing a temperature characteristic of loss tangent of the preferred viscoelastic polymer according to an embodiment of the invention.

FIG. 1 is a bottom view showing a cleaning surface of a cleaning sheet 1 according to one embodiment of the present invention; FIG. 2 is a sectional view taken along line II-II of FIG. 1; FIG. 3 is an exploded perspective view of the cleaning sheet 1; FIG. 4 is a perspective view showing a state where the cleaning sheet 1 is attached to a cleaning head of a cleaning device; FIG. 5 is a front view of the cleaning head; FIG. 6 is a bottom view of the cleaning head; FIG. 7 is a diagram showing a temperature characteristic of storage modulus of a preferred viscoelastic polymer; and FIG. 8 is a diagram showing a temperature characteristic of loss tangent of the preferred viscoelastic polymer.

As shown in FIGS. 1 to 3, the cleaning sheet 1 includes a rectangular main body having an attachment surface 1*b* to be applied to a bottom face 23 of a pad 22 of a cleaning head 11 (which will be described later) and a cleaning surface 1*a* to be applied to a floor surface or the like. As shown in FIG. 1, the rectangular main body has parallel longer sides 1*c*, 1*c* and parallel shorter sides 1*d*, 1*d*. When the cleaning sheet 1 is used for cleaning the floor surface or the like, one of the longer sides 1*c*, 1*c* is to be situated forward in a wiping direction.

As shown in the exploded perspective view of FIG. 3, the rectangular main body may be constructed by stacking an exterior nonwoven fabric 2, a liquid permeable sheet 3, a liquid absorbent sheet 4 and a backing sheet 5 in the order mentioned above from the cleaning surface 1*a* to the attachment surface 1*b*. On the main body, furthermore, there is provided a pair of attachment sheet 6, 7.

The individual sheets have an equal width W in a direction from side to side (hereinafter called the "transverse direction"). In a direction from front to rear (hereinafter called the "longitudinal direction"), on the other hand, the exterior nonwoven fabric 2 has a length L2, the liquid permeable sheet 3 has a length L3, the liquid absorbent sheet 4 has a length L4 and the backing sheet 5 has a length L5. As shown in FIG. 1, the length L3 of the liquid permeable sheet 3 is equal to the length of the shorter side 1*d* of the rectangular main body.

The length L4 of the liquid absorbent sheet 4 is preferably equal to the length L5 of the backing sheet 5, and the length L4/L5 is preferably shorter than the length L3 of the liquid permeable sheet 3. As shown in FIG. 2, therefore, one longer side 3*a* of the liquid permeable sheet 3 is at a distance from one longer side 4*a* of the liquid absorbent sheet 4. Likewise, the other longer side 3*b* of the liquid permeable sheet 3 is at a distance from the other longer side 4*b* of the liquid absorbent sheet 4.

The length L2 of the exterior nonwoven fabric 2 is preferably shorter than the length L3 of the liquid permeable sheet 3 and the length L4 of the liquid absorbent sheet 4. In a side region 9 which extends along the longer side 1*c* with a length La, the cleaning surface 1*a* of the cleaning sheet 1 is preferably not covered with the exterior nonwoven fabric 2 and the liquid permeable sheet 3 covering the liquid absorbent sheet 4 is exposed externally, as shown in FIG. 2. In a central region 8, on the other hand, the cleaning surface 1*a* is covered with the exterior nonwoven fabric 2.

The dimensions of the main body (or the cleaning surface 1*a*) are not particularly limited as long as the cleaning sheet 1 can be suitably used for wiping a floor surface or the like, but for instance, the length L3 may be about 60 to 160 mm, the width W may be about 200 to 320 mm. The length La of the side region 9 is preferably 5 mm or more, more preferably 10 mm or more.

The exterior nonwoven fabric 2 and the liquid permeable sheet 3 both preferably contain heat-fusible synthetic resin fibers. In the central region 8, as shown in FIGS. 1 and 2, the exterior nonwoven fabric 2, the liquid permeable sheet 3 and the liquid absorbent sheet 4 are preferably joined together to have a plurality of parallel join lines 71 by heating under pressure, such as by heat embossing or ultrasonic embossing. The backing sheet 5 is preferably bonded to the liquid absorbent layer 4 through a hot-melt type adhesive.

The exterior nonwoven fabric 2 and the liquid permeable sheet 3 are also fixed to each other at join lines 72. The join lines 72 are preferably formed by heating under pressure, such as by embossing the exterior nonwoven fabric 2 and the liquid permeable sheet 3. The join lines 72 are spaced inward from the longer sides 2*a*, 2*b* of the exterior nonwoven fabric 2 and extend parallel to the longer sides 2*a*, 2*b*.

Along the longer side 2*a*, as shown in FIG. 2, the exterior nonwoven fabric 2 preferably provides a flap 61 which is allowed to move freely while being fixed on the cleaning surface 1*a* at the join line 72. Along the longer side 2*b*, likewise, the exterior nonwoven fabric 2 provides another flap 61. When the cleaning sheet 1 is slid on the floor surface with the longer sides 1*c*, 1*c* directed forward and rearward in the sliding direction, the flaps 61, 61 function to remove dirt adhering to the floor surface. The flap 61 has a free length Lb which is preferably 0.5 mm or more, more preferably 1 mm or more. If the free length Lb is excessively long, the frictional resistance between the cleaning surface 1*a* and the floor surface may be increased. Therefore, the free length Lb is preferably 10 mm or less, more preferably 5 mm or less.

At the transverse center, the attachment sheets 6, 7 preferably have indentations 6*a*, 7*a*. The indentations 6*a*, 7*a* preferably face each other as shown in FIG. 3.

As shown in FIG. 2, the longer side 6*b* of the attachment sheet 6 is aligned with the longer side 3*a* of the liquid permeable sheet 3, and the liquid permeable sheet 3 and the attachment sheet 6, which are in face-to-face contact, are preferably bonded together through a hot-melt type adhesive to provide a join line 73 outside the longer side 4*a* of the liquid absorbent sheet 4. The join line 73 is parallel to the longer side 3*a* of the liquid permeable sheet 3 and preferably extends the entire length of the cleaning sheet 1 in the transverse direction. Likewise, the longer side 7*b* of the attachment sheet 7 is aligned with the longer side 3*b* of the liquid permeable sheet 3, and the liquid permeable sheet 3 and the attachment sheet 7 are preferably bonded together to provide another join line 73 outside the longer side 4*b* of the liquid absorbent sheet 4.

The surface of the backing sheet 5 (or the attachment surface 1*b*) has a viscoelastic polymer for preventing slipping. The term "viscoelastic" as used herein refers to such a property that when a cone-shaped or disc-shaped sensor is put on a polymeric material layer of a given thickness and rotated reciprocally in positive and reverse directions, the strain curve (variation curve of strain caused by the sensor in the polymeric material layer) and the stress curve (variation curve of strain) have a phase difference δ which is greater than 0 degrees and less than 90 degrees.

The viscoelastic polymer may be a rubber-based elastomer. Examples of the rubber-based elastomer include thermoplastic elastomers such as SEBS (styrene ethylene butylene styrene block copolymer), SBS (styrene butadiene styrene block copolymer), SBBS (styrene butadiene butylene styrene block copolymer), SIS (styrene isoprene styrene block copolymer), etc. Such thermoplastic elastomers may be melted by heat and applied to the sheet surface in a hot, molten state.

In an alternative, the thermoplastic elastomers may be dispersed in a solvent, sprayed in an emulsion state on the backing sheet 5 and fixed on the sheet surface by evaporating the solvent.

Examples of the rubber-based elastomer also include SBR (styrene butadiene rubber), BR (butadiene rubber), NBR (nitrile butadiene rubber), etc. They may be applied in a latex state to the surface of the backing sheet 5.

Examples of the rubber-based elastomer further include IR (isoprene rubber), FR (fluoro rubber), etc.

In an alternative, the viscoelastic polymer may be a silicone-based elastomer or a urethane-based elastomer.

The foregoing elastomers may also be dissolved in a solution and applied in a solution state to the surface of the backing sheet 5.

The viscoelastic polymer preferably has a low tack strength. As the tack strength becomes higher, the surface tackiness of the backing sheet 5 increases so that when unpacked, the cleaning sheet may stick to the user's hand and feel unpleasant. However, the cleaning sheet 1 may be stored with the attachment sheets 6, 7 laid on the attachment surface 1*b* (or the backing sheet 5). Accordingly, even if the viscoelastic polymer has a relatively high tack strength, the cleaning sheet 1 whose attachment surface 1*b* is covered with the attachment sheets 6, 7 can be prevented from adhering to another cleaning sheet 1 during storage.

The viscoelastic polymer is preferably applied in an amount of 1 to 10 g/m$^2$ to the surface of the backing sheet 5. The viscoelastic polymer may be applied uniformly on the whole surface of the backing sheet 5 or in a stripe pattern or a dot pattern.

The exterior nonwoven fabric 2 is preferably a nonwoven fabric having a high fiber density, wherein at least 70 wt. % of constituent fibers are synthetic resin fibers treated to be hydrophilic or hydrophilic fibers, so that the exterior nonwoven fabric 2 is capable of being wetted by liquid and allows liquid applied to the sheet surface to pass through it toward the liquid absorbent sheet 4. For example, the exterior nonwoven fabric 2 may be a spunbonded nonwoven fabric.

The liquid permeable sheet 3 is preferably a low-density nonwoven fabric containing at least 70 wt. % of hydrophobic fibers. For example, the liquid permeable sheet 3 may be a through-air bonded nonwoven fabric in which polyethylene (PE) resin fibers, polypropylene (PP) resin fibers, polyethylene terephthalate (PET) resin fibers, PE/PP bicomponent synthetic resin fibers, or PE/PET bicomponent synthetic resin fibers are thermally bonded together by hot air.

The liquid absorbent sheet 4 may be a layered structure of a first absorbent sheet 4*d* and a second absorbent sheet 4*e*. Preferably, the first absorbent sheet 4*d* and the second absorbent sheet 4*e* are both an air-laid pulp which is manufactured by depositing pulp by air-laid process and then bonding the fibers through a resin binder. Alternatively, the liquid absorbent layer 4 may be a compressed deposited pulp. The liquid absorbent layer 4 preferably has a basis weight of about 50 to 200 g/m$^2$. The liquid absorbent layer 4 may further contain superabsorbent polymer (SAP).

The backing sheet 5 may be impermeable or permeable to liquid. In order to make the backing sheet 5 permeable to liquid, there may be used the same through-air bonded nonwoven fabric as used for the liquid permeable sheet or a spunlaced nonwoven fabric including rayon and pulp. In order to make the backing sheet 5 impermeable to liquid, there may be used a spunbonded nonwoven fabric or a composite nonwoven fabric (e.g., spunbonded/meltblown) treated by a water-repellent. Preferably used is a spunbonded nonwoven fabric formed of synthetic resin fibers treated to be hydrophilic and having a basis weight of 20 g/m$^2$.

The attachment sheets 6, 7 may be a point-bonded or spunbonded nonwoven fabric of synthetic resin fibers.

FIGS. 4 and 5 show a cleaning device 10 to which the cleaning sheet 1 may be attached. Cleaning device 10 may comprise a cleaning head 11, a shaft 13 connected to the top face of the cleaning head 11 through a universal joint 12, and a grip (not shown) secured on the top end of the shaft 13.

The cleaning head 11 is preferably constructed of a rigid holder 21 injection molded of a synthetic resin, such as acrylonitrile-butadiene-styrene (ABS), polyethylene (PE), polypropylene (PP), polyethylene terephthalate (PET), etc., and the pad 22 secured beneath the holder 21. The pad 22 is preferably formed of ethylene-vinyl acetate (EVA). Because EVA is superior in water resistance, the pad 22 will not deteriorate even if liquid is kept in the liquid absorbent sheet 4 of the cleaning sheet 1 during use.

EVA is superior in water resistance but its surface is smooth and has a lower coefficient of friction than urethane foam resin and the like. However, slipping of the cleaning sheet 1 relative to the cleaning head 11 can be prevented even if the pad 22 is formed of EVA, because the viscoelastic polymer for preventing slipping is provided on the backing sheet 5 of the cleaning sheet 1.

In an alternative, the pad 22 may be formed of another flexible elastic material such as urethane foam resin or rubber. In another alternative, the pad 22 may be formed of soft PP or PE.

As shown in FIG. 6, the bottom face 23 of the pad 22 is rectangular and has a longer side almost equal to or slightly smaller than the width W of the cleaning sheet 1 and a shorter side almost equal to or slightly smaller than the length L3 of the cleaning sheet 1. The bottom face 23 of the pad 22 is generally flat except for a shallow recess 23*a* which is formed in the bottom face 23 to face forward. The whole bottom face 23 is preferably formed with a large number of grooves crossing each other to define a large number of small projections 23*b* for increasing the coefficient of friction.

Inside the four corners of the top face, the holder 21 has sheet retainers 24. The sheet retainer 24 is preferably constructed by forming an opening in the top face of the holder 21 and covering the opening with a deformable sheet made of PE, PP, PET, etc. The deformable sheet has a cut. The cleaning sheet 1 may be retained on the cleaning head 11 such that the attachment sheets 6, 7 are pushed into the cuts.

As shown in FIG. 4, a liquid jetting part 30 is mounted on the holder 21. The liquid jetting part 30 is preferably located in front of the universal joint 12. The liquid jetting part 30 may be constructed of two components: a base 31 and a nozzle head 32. The nozzle head 32 has a front face (squirt surface) 33 where three nozzles 35, 36, 37 have orifices. In FIG. 4, the nozzles 35, 36, 37 face the indentation 6*a* of the attachment sheet 6.

Hereinbelow, how to use the cleaning device 10 will be described.

The cleaning sheet 1 is attached to the cleaning head 11 with its main body, in which the liquid absorbent sheet 4 is present, being laid on the bottom face 23 of the pad 22. The cleaning sheet 1 is fixed on the cleaning head 11 by placing the attachment sheets 6, 7 on the top face of the holder 21 and tucking them into the sheet retainers 24. Here, the viscoelastic polymer on the backing sheet 5 are in contact with the battom face 23 of the pad 22.

By pressing an operating part (not shown) with the grip being held by hand, liquid within a container mounted on the shaft 13 reaches a chamber provided inside the nozzle head 32 through a hollow of the shaft 13 and a pipe 44 and is then squirted forward from the nozzles 35, 36, 37 under force of gravity. After the floor surface is wetted with the liquid in front of the cleaning head 11, the cleaning head 11 is moved forward to wipe the floor with the cleaning sheet 1.

The liquid in the container may be plain water, or may contain a detergent for cleansing a floor surface, a high gloss wax, etc.

When the cleaning head 11 is slid on the floor surface, the liquid permeable sheet 3, which is exposed externally in the side regions 9, 9, can collect relatively large dust particles. In addition, the liquid, which may be fouled with fine dust particles on the floor surface, passes through the voids between the constituent fibers of the liquid permeable sheet 3 and is absorbed and retained by the liquid absorbent sheet 4. Moreover, the exterior nonwoven fabric 2 in the central region 8 is moderately wetted with the liquid to efficiently wipe off fine dust or dirt. Here, the flaps 61, 61, which are able to move freely on the cleaning surface 1*a* at boundaries between the central region 8 and the side regions 9, 9, also facilitate removal of the dirt adhering to the floor surface.

The cleaning sheet according to the present invention should not be construed as limited to use with the cleaning device 10. For example, the cleaning sheet may be attached to a cleaning device which has no nozzles for squirting liquid.

The attachment sheets 6, 7 may be integral with one of the sheets constituting the main body of the cleaning sheet 1.

Properties of Viscoelastic Polymer

As described hereinabove, the viscoelastic polymer according to the present invention preferably has a storage modulus of $10^4$ to $10^6$ (Pa) over the temperature range between −20° C. and 40° C., a peak value of loss tangent (tan δ) below −20° C., and a loop-tack strength equal to or less than 10 ounces. The loop-tack strength is more preferably equal to or less than 5 ounces. In order to stabilize viscoelasticity over the temperature range between −20° C. and 40° C., the viscoelastic polymer preferably has melt viscosities of 1000 to 3500 (mPa·S) at 120° C. and 100 to 400 (mPa·S) at 180° C. Hereinbelow, these properties will be described with reference to Example and Comparative Examples 1 and 2.

Storage Modulus G' & Loss Tangent δ

When a reciprocal rotational force is exerted on a polymeric material layer by the sensor, as set forth above, a phase difference δ occurs between the variation curve of strain ϵ in the polymeric material layer in both positive and reverse directions and the variation curve of stress τ. When the phase difference δ is 0 degrees, the polymer is a perfectly elastic material, whereas when the phase difference δ is 90 degrees, the polymer is a perfectly viscous material. As set forth above, the viscoelastic polymer has a phase difference δ greater than 0 degrees and less than 90 degrees.

Storage modulus G' is obtained by multiplying an absolute value of (τ/ϵ) and (cos δ) together and expressed in terms of (Pa). The storage modulus G' represents an energy that is stored and restored per one cycle of the reciprocal rotational movement of the sensor and may be used as an indication of the elastic component of the polymer. Loss tangent δ is G"/G', wherein G" is obtained by multiplying an absolute value of (τ/ϵ) and (sin δ) together. The loss tangent δ represents an energy that is lost as heat per one cycle of the reciprocal rotational movement of the sensor and may be used as an indication of the viscous component of the polymer.

FIG. 7 shows the storage modulus G' in ordinate logarithmic axis) and the temperature in abscissa, and FIG. 8 shows the loss tangent δ in ordinate (logarithmic axis) and the temperature in abscissa. In FIGS. 7 and 8, Example 1 is indicated by (i), Comparative Example 1 is indicated by (ii), and Comparative Example 2 is indicated by (iii). The results shown in FIGS. 7 and 8 were measured with a dynamic viscoelastic analyzer "Rheogel-E4000 (type HR500)" manufactured by UBM Co. Ltd.

EXAMPLE 1

Example 1 was prepared by mixing a small amount of viscosity imparting agent and oil with SEBS elastomer as a major component to have melt viscosities of 2100 (mPa·S) at 120° C., 700 (mPa·S) at 140° C., 360 (mPa·S) at 160° C., 230 (mPa·S) at 180° C.

Comparative Example 1

Comparative Example 1 was prepared by mixing a certain amount of viscosity imparting agent and oil with SBS elastomer as a major component to have melt viscosities of 20000 (mPa·S) at 120° C., 7500 (mPa·S) at 140° C., 3300 (mPa·S) at 160° C., 2000 (mPa·S) at 180° C.

Comparative Example 2

Comparative Example 2 was prepared by mixing a certain amount of viscosity imparting agent and oil with an olefin-based elastomer as a major component to have melt viscosities of 20000 (mPa·S) at 120° C., 9000 (mPa·S) at 140° C., 4500 (mPa·S) at 160° C., 2400 (mPa·S) at 180° C.

Explanation of FIGS. 7 and 8

Over the temperature range between −20° C. and 40° C. for practical use of the cleaning sheet 1, as indicated by (i) in FIG. 7, the storage modulus G' of Example 1 does not vary greatly and falls within the range of $10^4$ (Pa) to $10^6$ (Pa). On the other hand, the storage moduli G' of Comparative Examples 1 and 2, as indicated by (ii) and (iii), increase greatly in the temperature range between −20° C. and 40° C. so that Comparative Examples 1 and 2 will behave elastically, rather than viscoelastically.

FIG. 8 shows that Example 1 has a peak value (p) below −20° C. Since the peak value (p) represents the glass transition temperature (Tg), it is understood that Example 1 can retain viscoelasticity over the temperature range between −20° C. and 40° C. On the other hand, since Comparative Examples 1 and 2 have their peaks (or glass transition temperatures) within a temperature range between 10° C. and 20° C., they are not sufficiently effective in preventing slipping.

The viscoelastic polymer of Example 1 prevents slipping not only with tackiness but also with viscoelasticity. Therefore, the backing sheet 5 feels less tacky to the touch.

Loop-Tack Strength

Loop-tack strength was measured with a loop-tack tester "Accuforce Cadet" manufactured by AMETEK, Inc.

Samples (125 mm in MD; 25 mm in CD) were prepared by uniformly applying the individual polymers of Example 1, Comparative Example 1, Comparative Example 2 into a thickness of 50 μm on the surface of a PET sheet having a thickness of 50 μm. Each sample was situated on the loop-tack tester with the polymer facing outward and the load (ounce) was measured when the sample was adhered to and peeled from a PE plate at a rate of 300 mm/min The loop-tack strength of Example 1 was 0 ounces. On the other hand, Comparative Example 1 had a loop-tack strength of 80 to 90 ounces and Comparative Example 2 had a loop-tack strength equal to or less than 10 ounces.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A cleaning sheet comprising:

a main body having an attachment surface to be applied to a cleaning head of a cleaning device and a cleaning surface opposite the attachment surface; and attachment portions to be engaged to the cleaning head, wherein exactly one surface has a viscoelastic polymer for preventing slipping, and wherein said exactly one surface is said attachment surface, and wherein the viscoelastic polymer has a loop-tack strength equal to or less than 10 ounces.

2. The cleaning sheet of claim 1, wherein the viscoelastic polymer is selected from the group consisting of rubber-based elastomers, silicone-based elastomers and urethane-based elastomers.

3. The cleaning sheet of claim 1, wherein the viscoelastic polymer is a synthetic rubber comprising styrene and at least one of butylene, butadiene and isoprene.

4. The cleaning sheet of claim 1, wherein the viscoelastic polymer is applied to the attachment surface in a hot, molten state.

5. The cleaning sheet of claim 1, wherein the viscoelastic polymer is applied to the attachment surface in an emulsion, latex or solution state.

6. The cleaning sheet of claim 1, wherein the viscoelastic polymer has a storage modulus of $10^4$ to $10^6$ over a temperature range between −20° C. and 40° C.

7. The cleaning sheet of claim 6, wherein the viscoelastic polymer has a peak value of loss tangent below −20° C.

8. The cleaning sheet of claim 1, wherein the attachment surface is intended to be applied to a bottom face of the cleaning head which is made of ethylene-vinyl acetate.

9. The cleaning sheet of claim 1, which comprises a liquid absorbent sheet which enables cleaning with liquid absorbed in the cleaning sheet.

10. The cleaning sheet of claim 1, wherein the viscoelastic polymer is applied to said exactly one surface in an amount of 1 to 10 g/$m^2$ and an opposite surface is treated to be hydrophilic or comprises hydrophilic fibers.

11. The cleaning sheet of claim 1, wherein the viscoelastic polymer is applied uniformly over a whole surface of the attachment surface and wherein the cleaning surface is treated to be hydrophilic or comprises hydrophilic fibers.

12. The cleaning sheet of claim 1, wherein the cleaning surface is treated to be hydrophilic or comprises hydrophilic fibers.

13. A cleaning sheet comprising:

an exterior sheet exposed on a cleaning surface;

a backing sheet exposed on an attachment surface, and a liquid absorbent sheet situated between said exterior sheet and said backing sheet;

wherein a viscoelastic polymer is applied only to the backing sheet for preventing the cleaning sheet from slipping with respect to a cleaning head;

the exterior sheet is treated to be hydrophilic or comprises hydrophilic fibers; and the viscoelastic polymer has a loop-tack strength equal to or less than 10 ounces.

14. The cleaning sheet of claim 13, wherein the backing sheet is liquid impermeable.

15. The cleaning sheet of claim 13, wherein the viscoelastic polymer is uniformly applied to the entire surface of the backing sheet.

16. A method for improving a contact between an attachment surface of a cleaning sheet to a cleaning head, comprising:

applying viscoelastic polymer uniformly over exactly one surface of the cleaning sheet; wherein the viscoelastic polymer has a loop-tack strength equal to or less than 10 ounces.

* * * * *